United States Patent [19]

Van Siclen

[11] 4,132,034

[45] Jan. 2, 1979

[54] REFRIGERATOR DOOR WITH DOUBLE ACTING HINGE

[76] Inventor: William C. Van Siclen, 546-A Miner Rd., Orinda, Calif. 94563

[21] Appl. No.: 844,568

[22] Filed: Oct. 25, 1977

[51] Int. Cl.[2] ..... E05D 15/50

[52] U.S. Cl. ..... 49/382; 16/147; 49/193; 312/138 R

[58] Field of Search ..... 312/109, 236, 138 R; 49/382, 192, 193; 16/147

[56] References Cited

U.S. PATENT DOCUMENTS

| | | | |
|---|---|---|---|
| 2,166,534 | 7/1939 | Rosenfeld | 16/147 |
| 2,357,397 | 9/1944 | Fuller | 16/147 |
| 2,790,992 | 5/1957 | Campbell | 16/147 |

*Primary Examiner*—Mervin Stein
*Assistant Examiner*—Alex Grosz
*Attorney, Agent, or Firm*—Townsend and Townsend

[57] ABSTRACT

A door and frame assembly is disclosed wherein the door is capable of swinging about either one of two axes, for example, the right or the left side. The mounting of the door to the frame is accomplished by at least paired hinge straps. Each hinge strap pair has two separate members, each consisting of a central portion which is of a length approximately equal to the width of the door, and two hinged end segments, one at each end. One end segment fastens to the door on one side; the other fastens to the frame on the opposite side. The second of the pair of hinge straps is connected to the frame and door in a manner similar to that of the first, except that the door and frame connections are interchanged. Thus, when the door is in its closed position, both of these hinge straps extend across the opening from one hinge axis to the other hinge axis. When the door is opened about one hinge axis, the first strap extends across the frame while the second strap extends across the door. When the door is opened about the second hinge axis, the first strap extends across the door while the second strap extends across the frame.

10 Claims, 6 Drawing Figures

REFRIGERATOR DOOR WITH DOUBLE ACTING HINGE

BACKGROUND OF THE INVENTION

It is often desirable or necessary to have a door that can swing about one of two axes. In many applications these two axes will be parallel and vertical. This is true of fixed doorways, but the desirability or need may be especially acute in the case of appliances or other devices that are likely to be relocated. For example, it may be impractical or impossible to locate a refrigerator in a spot otherwise convenient due only to the fact that the refrigerator door opens from a particular side.

Several approaches have been taken to meet this need. It is now common for refrigerators to be convertible from right hand to left hand opening appliances the conversion typically requiring removal of the door and relocation of the hinges and magnetic latch. However, this solution is not responsive to the situation where it is only occasionally necessary to open the door from the side that is not the one from which it normally opens.

Various approaches have been tried to provide a door that can be opened from either side at the whim of the user. An old pencil-box design used four flexible ribbons, two parallel and two crossing one another, across the top to allow opening from either side. U.S. Pat. No. 3,889,419 provides hinge pins along both axes, and a system of sliding bolts to engage one or the other sets of hinge pins. U.S. Pat. No. 3,733,749 provides door mounted rotary bearings with arcuate slots that co-act with arcuate projections on the frame.

Aside from the pencil-box, these prior art devices tend to be restricted to refrigerator use due to their complexity or need for close tolerances. The pencil-box approach was only suitable for extremely light weight and small applications.

SUMMARY OF THE INVENTION

A door and frame assembly is disclosed wherein the door is capable of swinging about either one of two axes, for example, the right or the left side. The mounting of the door to the frame is accomplished by at least paired hinge straps. Each hinge strap pair has two separate members, each consisting of a central portion which is of a length approximately equal to the width of the door, and two hinged end segments, one at each end. One end segment fastens to the door on one side; the other fastens to the frame on the opposite side. The second of the pair of hinge straps is connected to the frame and door in a manner similar to that of the first, except that the door and frame connections are interchanged. Thus, when the door is in its closed position, both of these hinge straps extend across the opening from one hinge axis to the other hinge axis. When the door is opened about one hinge axis, the first strap extends across the frame while the second strap extends across the door. When the door is opened about the second hinge axis, the first strap extends across the door while the second strap extends across the frame.

OBJECTS AND ADVANTAGES

It is an object to disclose improved hinge means and the installation thereof in a door and frame assembly so that the door is capable of being opened about either of two hinge axes.

An advantage of such a double acting hinge is that it provides the user with the convenience of opening the door from one side or the other on an intermittent or day-to-day basis. That is, the door may occasionally be opened from the side opposite that from which it is usually opened. Additionally, the double acting hinge provides flexibility, both in the case of a fixed frame installation and in a cabinet installation. For the fixed frame installation, a greater variety of furniture configurations about the door opening is possible without having to rehang the door. For cabinet installations, the cabinet may be placed in a greater variety of locations without concern as to which way the door opens.

A further advantage of the double action hinge insures to manufacturers and sellers of appliances incorporating it. No longer is it necessary to manufacture or stock two types of essentially the same item; namely, right hand and left hand versions. Rather, a single model does the job of both.

A further object of the invention is to disclose hinge means comprising paired hinge straps each of which consists of a central portion and two hinged end portions. One hinged end portion of one strap is connected to the door frame and the other end portion is connected to the door at the opposite end. The second hinge strap is connected to the door and frame in a similar fashion, except that the door and frame connections are interchanged.

An advantage of this configuration is that it is suitable for use in appliance, furniture, and fixed door frame applications.

A further advantage of this invention is that it is relatively inexpensive to manufacture the required parts.

Yet another advantage of the present invention is that while paired hinge straps are used, in the case of parallel hinge axes both such straps may be identical. Thus, it is only necessary to manufacture one such item.

Yet another advantage of the present invention is the fact that it is suitable for use where the hinge axes are not parallel. Thus, for example, a pyramidal cabinet may be constructed with a front triangular door that is capable of being opened about either of two edges.

Other objects and advantages of the present invention will become clear upon a reading of the following specification and reference to the attached drawings.

DETAILED DESCRIPTION OF THE DRAWINGS

Figure 1:
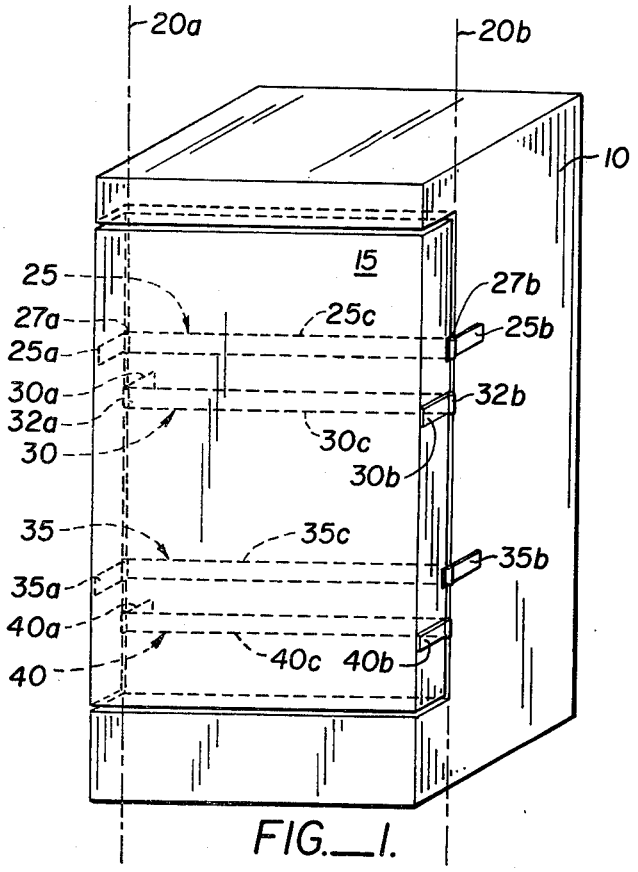
FIG. 1 shows a cabinet with the hinge straps as they appear when the door is in the closed position. The members of each pair of hinge straps are shown separated slightly for clarity.

FIG. 1 shows a cabinet 10 having a rectangular opening overlaid and blocked by door 15. The purpose of this invention is to provide hinge means so that door 15 is capable of swinging about either of the two hinge axes 20*a* or 20*b*.

Two pairs of hinge straps are shown, but only the upper pair will be described since the lower pair functions in exactly the same way. Hinge strap 25 consists of central portion 25c extending across door 15 and the opening in cabinet 10. End segments 25a and 25b are hingedly fastened to central portion 25c by means of hinges 27a and 27b. The orientation of hinges 27a and 27b is such that the hinged movement of end segments 25a and 25b occurs about hinge axes 20a and 20b when central portion 25c extends across the door and opening as shown. Hinge strap 30 consisting of central portion 30c and hingedly fastened end segments 30a and 30b, held together by hinges 32a and 32b, is also shown mounted across the door and opening. The dual opening feature of this invention arises from the manner in which end segments 25a, 25b, 30a and 30b are fastened to the door and frame.

End segment 25a is fastened to door 15 along the side closest to hinge axis 20a, while end segment 25b is fastened to the side of the cabinet nearest hinge axis 20b. Hinge member 30 is fastened in a similar way, except that the door and frame connections are interchanged. Thus, end sement 30a is fastened to the side of the cabinet nearest hinge axis 20a, while end segment 30b is fastened to the side of the door nearest hinge axis 20b. The connections between the end segments and the door or the cabinets are rigid. Paired hinge straps 35 and 40 are connected to the door and cabinet in the same fashion as hinge straps 25 and 30, respectively.

Figure 2:
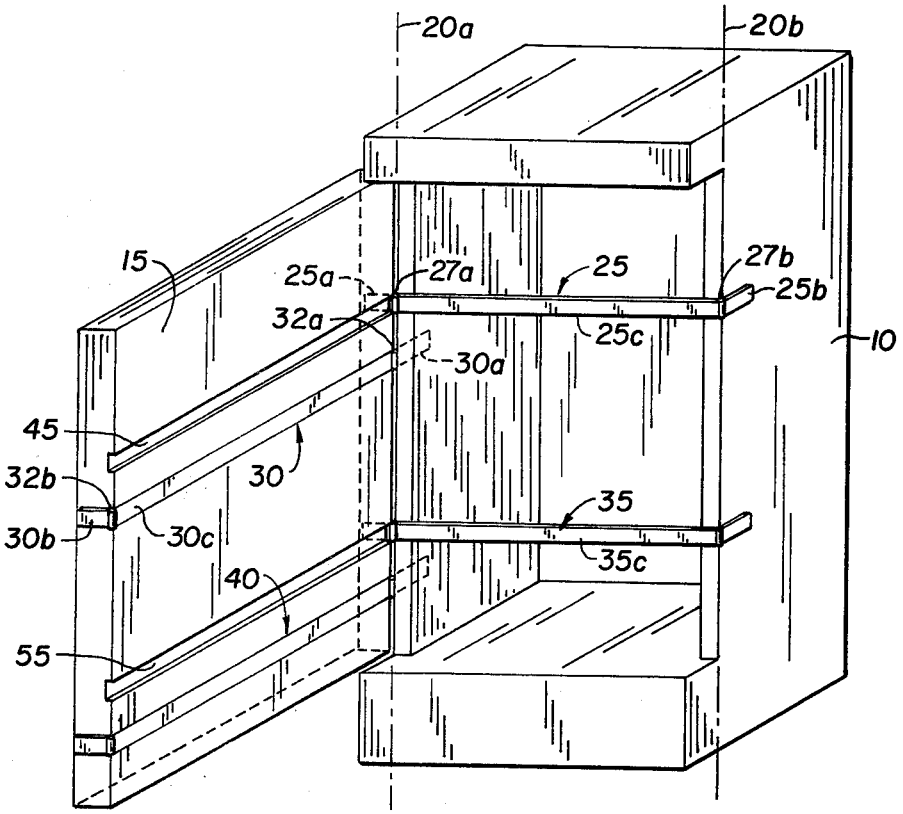
FIG. 2 shows a cabinet and the hinge straps as they appear when the door is opened from the right side.
Figure 3:
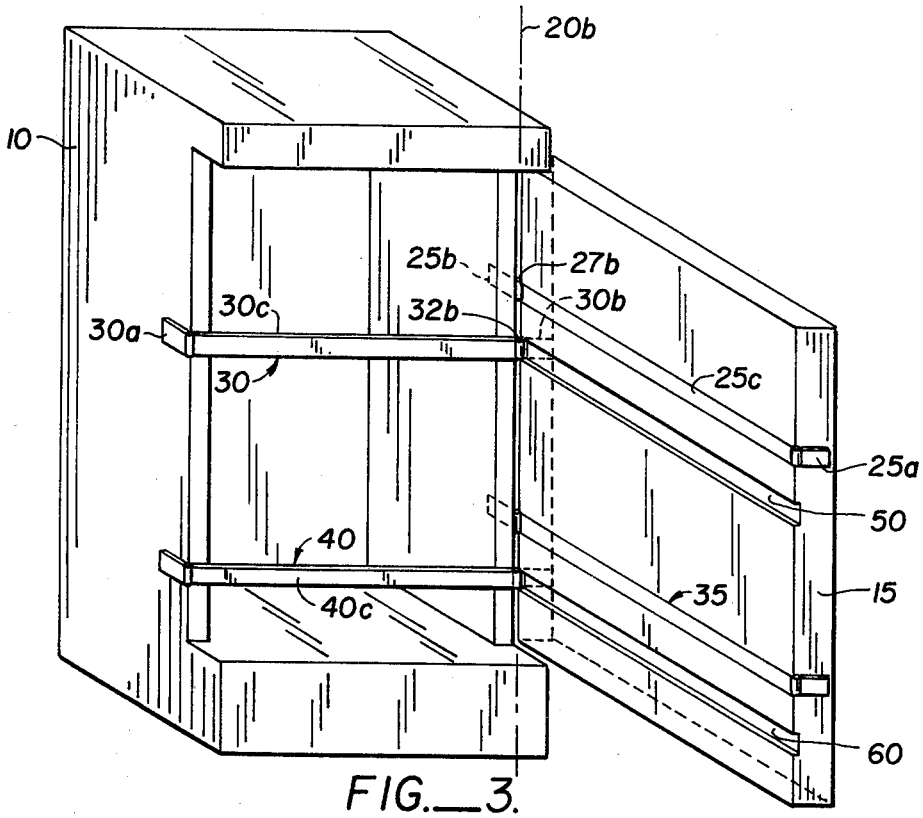
FIG. 3 shows a cabinet and the hinge straps as they appear when the door is opened from the left side.

Referring to FIGS. 2 and 3, the dual acting feature of the present invention can now be understood. In FIG. 2, door 15 is shown swung open about hinge axis 20a. In this position, hinges 27b and 32b serve as rigid connections, while the actual hinge motion is provided by hinges 27a and 32a. Hinges 27a and 32a remain aligned along hinge axis 20a. That is, hinges 27a and 32a are not displaced relative to their positions when door 15 is closed. Since hinge 32b is along the edge of the door that is swung out from the opening, hinge 32b is displaced from the position it occupies when door 15 is closed. Thus, central portion 30c extends across the door while central portions 25c extends across the opening.

FIG. 3 shows door 15 swung open about hinge axis 20b. Here, hinge motion is provided by hinges 27b and 32b. In this open position, central portion 30c extends across the opening, while central portion 25c extends across the door.

Due to the fact that the rigid connection to the door and the rigid connection to the frame are separated by the width of the door, sagging can be a problem. One solution is to prevent relative movement between the hinge strap central portion and the door when the strap confronts the door.

A convenient way of doing this is shown in FIGS. 2 and 3. Door 15 is provided with recesses 45, 50, 55 and 60, into which central portions 25c, 30c, 35c, and 40c, respectively, can fit when they confront door 15. These recesses must clearly capture the hinge strap central portions, In order to avoid the problem where a slight misalignment of the door prevents proper confrontation and capture, the recesses may be made slightly wider at the door surface and tapered inwardly to the strap width. It should also be noted that recesses 45, 50, 55 and 60 also prevent the hinge straps from interfering with the door's snugly confronting the frame. This wouldn't be noteworthy where the door was hunge within rather than against the frame. The recessed straps might still be preferable from an aesthetic standpoint, however.

Figure 5:
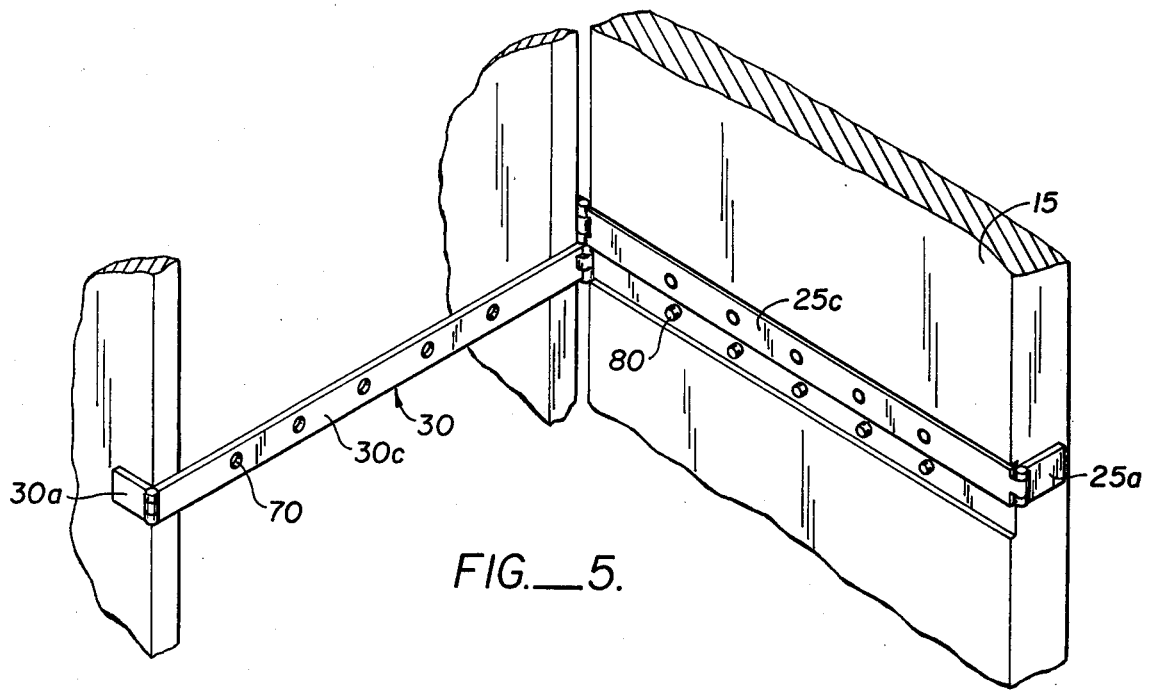
FIG. 5 is a fragmentary view showing a pin and aperture arrangement for preventing sagging of the door.

FIG. 5 shows an alternate arrangement for supporting the door. Like reference numerals are used where applicable. Central portion 30c of hinge strap 30 is provided with a plurality of holes 70. A corresponding plurality of pins 80 extend from the plane of door 15 and register with holes 70, passing therethrough, when strap 30 and door 15 come into contact. Pins 80 may be tapered to facilitate engagement. While FIG. 5 shows the holes extending uniformly across strap 30c, it should be noted that the need for support is greatest near the end of the strap that is hinged to the frame. The pin and hole arrangement described above may be used in connection with the paired recesses of FIGS. 2 and 3, or both hinge straps may abut and fit into a single recess.

Figure 4:
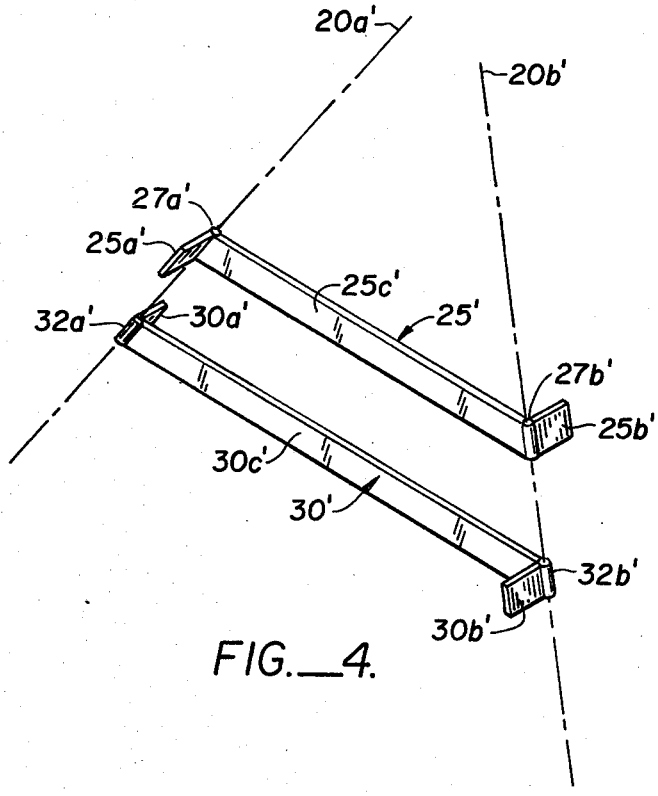
FIG. 4 shows hinge straps suitable for use where the hinge axes are not parallel.

While FIGS. 1–3 show hinges axes 20a and 20b to be parallel and vertical, the present invention is not so limited. FIG. 4 shows hinge straps for nonparallel hinge axes 20a' and 20b'. Primed reference numerals correspond to those in FIGS. 1–3. Hinges 27a' and 27b' are no longer parallel, but are mounted at an angle equal to that between hinge axes 20a' and 20b'. While the hinged strap functions the same as in the parallel case, two important differences arise from the nonparallelism of the hinged axes. In the parallel case, the separation between the hinges is the same for both hinge straps. Therefore, the two hinge straps may be mounted at any convenient location and separation, so long as they do not overlap. Moreover, hinge straps 25 and 30 can be identical members, with the difference in functions being provided by rotating one of them 180° relative to the other. In the nonparallel case, the location relative to the opening and, hence, the separation of the two members is fixed by the constraint that hinges 27a' and 32a' lie along hinge axis 20a' while hinges 27b' and 32b' lie along hinge axis 20b'. Moreover, hinge straps 25' and 30' cannot be identical due to the differing separations of the hinges.

It will be noted that when door 15 is in either of its open positions, one of each pair of hinge straps extends across the opening, thus possibly impairing access or passage. There are two basic ways to alleviate this problem. First, the hinge straps can be mounted near the top and bottom of the door so as to minimize the interference with access through the opening. Alternately, recognizing that refrigerators and other cabinets normally contain horizontal shelves inside, the hinge straps can be mounted at positions corresponding to those of the shelves. Thus, the hinge straps extending across the opening would be essentially even with the front of the shelves and would not add any further impediment to access.

Figure 6:
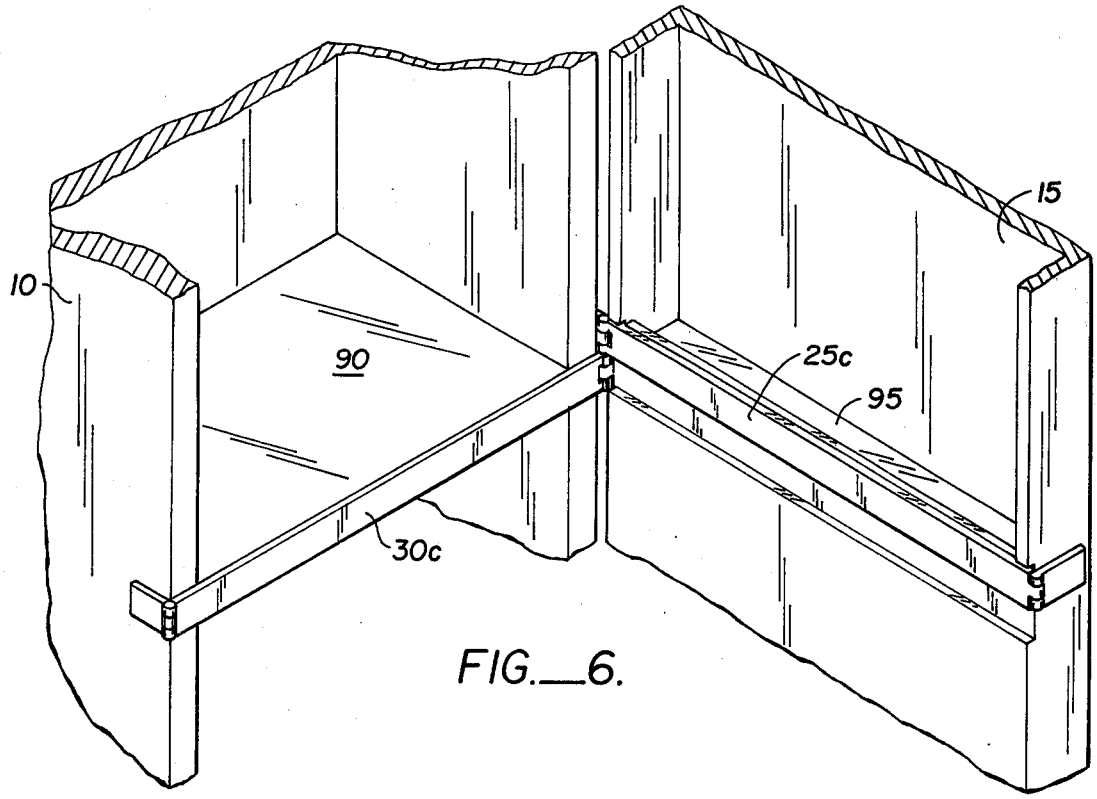
FIG. 6 is a fragmentary view showing a cabinet having a shelf therein opposite the hinge straps.

FIG. 6 illustrates a shelf 90 within cabinet 10 and a shelf 95 within door 15. Hinge strap central segments 30c and 25c are proximate the front edges of shelves 90 and 95, and therefore do not further impede access. The shelves may have a thickness sufficient so that both hinge straps lie across their front edges when door 15 is closed, or the shelf may be thinner and one or both of the hinge straps could serve as a front barrier to prevent items on the shelf from falling out. This would be especially useful in connection with shelf 95 within door 15.

What is claimed is:

1. In a door assembly consisting of a frame defining an opening having first and second sides, a door having first and second edges corresponding to said first and second sides, said door being capable of assuming a closed position wherein said door blocks said opening, the means allowing said door to assume in addition to said closed position two open positions, one from each of said sides, the improvement comprising: at least one pair of hinge straps mounting said door to said frame, each of said straps having a central portion of a length substantially equal to the distance between said first and second sides of said frame, and first and second end segments hingedly fastened to said central portion, said central portions extending across said opening when said door is in its closed position; means for rigidly fastening said first end segment of said first strap to said first side of said frame, means for rigidly fastening said second end segment of said first strap to said second edge of said door; means for rigidly fastening said first end segment of said second strap to said first edge of said door; and means for rigidly fastening said second end segment of said second strap to said second side of said frame, whereby said first strap central segment extends across said opening and said second strap central segment extends across said door when said door is opened from said first side, and whereby said first strap central segment extends across said door and said second strap central segment extends across said opening when said door is opened from said second side.

2. The door assembly of claim 1 comprising also means for preventing movement of said door in the plane of said door relative to said central portion of said first hinge strap when said door confronts said first hinge strap.

3. The door assembly of claim 2 wherein said door has a recess extending thereacross, said recess being adapted to receive said central portion of said first hinge strap when said first hinge strap central portion confronts said door.

4. In a door and frame assembly for hinged movement of the door relative to the frame having the combination of a frame defining an opening having two sides, a door having two corresponding edges, said door being capable of assuming a closed position between said sides where said door blocks said opening, and first and second hinge means for allowing said door to assume either of two open positions about two hinge axes, one hinge axis being substantially parallel to and coincident with one side of said frame, the other hinge axis being substantially parallel to and coincident with the other side of said frame, the improvement in each of said first and second hinge means comprising: a first hinged end portion at one end; a second hinged end portion at the other end; strap means connecting said end portions by a length substantially equal to the distance between two said hinge axes, said strap means extending across the opening between said hinge axes when said door is in said closed position; first and second hinges attaching said first and second hinged end portions to said strap means; means for attaching said first hinged end portion to a side of said frame; and means for attaching said second hinged end portion to said door at a side on said door opposite from said side of said frame; wherein said second hinged end portion permits hinged movement of said door about said second hinge when said second hinge is registered to one of said hinged axes while said second hinged end portion permits said strap means to extend across said opening.

5. A hinge assembly for mounting a door to a frame such that the door may be opened about either of two axes of rotation comprising: first and second hinge straps, each hinge strap having a central portion, first and second end portions, first and second hinge means fastening said end portions to said central portions, said first and second hinge means defining first and second hinge axes and an angle between said first and second hinge axes, said angle for said first hinge strap being substantially equal to said angle for said second hinge strap, said first and second hinge straps being capable of noncoincident placement wherein said first and second hinge axes of said hinge strap are respectively coincident with said first and second hinge axes of said second hinge strap.

6. In an appliance cabinet having a front opening and a door capable of covering said opening, said door also capable of hinged movement about either of two hinge axes, said opening having first and second sides corresponding to said hinge axes, said door having first and second edges corresponding to said hinge axes, the improvement comprising: first and second hinge straps mounting said door across said opening, each of said straps having a central portion of a length substantially equal to the distance between said hinge axes, and first and second end segment hingedly fastened to said central portion, said central portions extending across said opening when said door is in closed position; means for rigidly fastening said first end segment of said first strap to said first side of said frame; means for rigidly fastening said second end segment of said first strap to said second edge of said door; means for rigidly fastening said second end segment of said first strap to said second edge of said door; means for rigidly fastening said first end segment of said second strap to said first edge of said door; and means for rigidly fastening said second end segment of said second strap to said second side of said frame, whereby said first strap central segment extends across said opening and said second strap central segment extends across said door when said door is opened about said second hinge axis, and whereby said first strap central segment extends across said door and said second strap central segment extends across said opening when said door is opened about said first hinge axis.

7. The appliance cabinet of claim 6 comprising also a horizontal shelf having a front edge which extends across said opening when said door is in its closed position, and wherein said first hinge strap central portion overlies said front edge of said shelf when said door is in its closed position.

8. The appliance cabinet of claim 7 wherein said shelf is mounted within said door.

9. The appliance cabinet of claim 6 wherein said first and second hinge axes are parallel to each other.

10. The appliance cabinet of claim 6 wherein said first hinge strap central portion has a plurality of holes and said door has a plurality of pins extending perpendicularly from the plane of said door toward the interior of said cabinet when said door is in said closed position, said pins being adapted to pass through said holes in said first hinge strap central portion when said first hinge strap central portion confronts said door, the transverse dimensions of said pins corresonding to the transverse dimensions of said holes such that motion of said central portion of said first hinge strap perpendicular to said pins is prevented when said pins pass through said holes.

* * * * *